US007682229B2

(12) United States Patent
Kurokawa

(10) Patent No.: US 7,682,229 B2
(45) Date of Patent: Mar. 23, 2010

(54) COIN INSERTION DEVICE

(75) Inventor: Nobuo Kurokawa, Tochigi-ken (JP)

(73) Assignee: Bandai Co., Ltd., Tokyo (JP)

( * ) Notice: Subject to any disclaimer, the term of this patent is extended or adjusted under 35 U.S.C. 154(b) by 360 days.

(21) Appl. No.: 10/583,313

(22) PCT Filed: Dec. 15, 2003

(86) PCT No.: PCT/JP03/16063

§ 371 (c)(1),
(2), (4) Date: Nov. 13, 2007

(87) PCT Pub. No.: WO2005/059846

PCT Pub. Date: Jun. 30, 2005

(65) Prior Publication Data

US 2008/0171507 A1 Jul. 17, 2008

(51) Int. Cl.
*G07D 1/00* (2006.01)

(52) U.S. Cl. ..... 453/18

(58) Field of Classification Search ..... 453/18; 235/1 A

See application file for complete search history.

(56) References Cited

U.S. PATENT DOCUMENTS 2,721,641 A * 10/1955 Eames ..... 194/225

FOREIGN PATENT DOCUMENTS

| | | | |
|---|---|---|---|
| DE | 1958 638 | | 6/1970 |
| GB | 1 425 208 | | 2/1976 |
| GB | 1 444 735 | | 8/1976 |
| JP | 52-79009 | | 6/1977 |
| JP | 1-133676 | | 9/1989 |
| JP | 7-29678 | | 6/1995 |
| JP | 2002-279482 | * | 9/2002 |

OTHER PUBLICATIONS

Supplementary European Search Report Application/Patent No. 03778939.3-2221 PCT/JP0316063 dated Dec. 17, 2007.

* cited by examiner

*Primary Examiner*—Patrick Mackey
*Assistant Examiner*—Mark Beauchaine
(74) *Attorney, Agent, or Firm*—Buchanan Ingersoll & Rooney PC

(57) ABSTRACT

A coin insertion device with a shutter, where the device has a simple structure, can be produced at low cost, and does not require the use of electricity. A coin insertion device (1) is provided with a shutter member (30) for opening and closing a coin discharge opening (11) of a coin passage (12) and holding means (56) for holding the shutter member (30) in a non-rotatable state with the coin discharge opening (11) closed. The shutter member (30) comprises releasing means (40) with which a coin (C) inserted from a coin insertion opening (10) comes in contact. When the coin (C) is in contact with the releasing means (40), the shutter member (30) is released from the hold of the holding means (56) and becomes openable/closable.

2 Claims, 8 Drawing Sheets

COIN INSERTION DEVICE

TECHNICAL FIELD

The present invention relates to a coin insertion device having a coin passage comprising a coin insertion opening and a coin discharge opening, and a shutter member that opens and closes the coin discharge opening.

BACKGROUND ART

Conventionally, as disclosed in, for example, Japanese Patent Laid-Open No. 2002-279482 (Patent Document 1), a coin insertion device includes a coin passage comprising a coin insertion opening and a coin discharge opening, and a shutter member that opens and closes the coin discharge opening. The shutter member is provided in a freely rotating condition and it can be forcefully rotated by a rotation mechanism comprising an electrical driving source such as a drive motor. Prior to coin insertion the coin passage is blocked by the shutter member, and at the time of coin insertion the shutter member is rotated by the rotation mechanism to open the coin passage.

In the conventional coin insertion device, a shutter member is rotated by a rotation mechanism equipped with an electrical driving source, and electricity is required to open and close the coin passage. There is thus a problem that the device cannot be installed in an automatic vending machine that does not use electricity, such as a capsule dispenser that is provided in front of a store. There is also a problem that the structure required to perform rotation of the shutter member by electrical processing is complex, and can not be produced at a low cost.

The present invention was made in view of the above-described problems, and an object of this invention is to provide a coin insertion device equipped with a shutter member that has a simple structure and can be produced at a low cost, and which can be installed in an automatic vending machine or the like which does not use electricity.

DISCLOSURE OF INVENTION

In order to achieve the above object, a coin insertion device according to an exemplary embodiment of this invention comprises, in a device main body, a coin passage comprising a coin insertion opening and a coin discharge opening; a shutter member that opens and closes the coin discharge opening; and holding means for holding the shutter member in a state in which it keeps the coin discharge opening closed; wherein the shutter member comprises releasing means with which a coin inserted from the coin insertion opening comes into contact, and by contact of a coin inserted from the coin insertion opening with the releasing means the shutter member is released from a hold of the holding means and allowed to open and close.

In order to achieve the above object, a coin insertion device according to an exemplary embodiment of this invention comprises in a device main body, a coin passage comprising a coin insertion opening and a coin discharge opening; a shutter member that can rotate in directions that open and close the coin discharge opening; an elastic member that operates the shutter member in a direction that closes the coin discharge opening; and holding means for holding the shutter member in a non-rotatable condition in a state in which the shutter member keeps the coin discharge opening closed; wherein the shutter member comprises releasing means that protrudes into the coin passage and with which a coin inserted from the coin insertion opening comes in contact, and by contact of a coin inserted from the coin insertion opening with the releasing means the shutter member is released from a hold of the holding means and allowed to open and close.

In order to achieve the above object, in a coin insertion device according to an exemplary embodiment of this invention, the shutter member is rotatable along a rotation center line and may also be operated in the direction that closes the coin discharge opening and one direction on the rotation center line by the elastic member, and the holding means holds the shutter member in the non-rotatable condition when the shutter member is in a state in which it is operated in one direction on the rotation center line, and by contact of a coin inserted from the coin insertion opening by the releasing means the shutter member moves in another direction on the rotation center line against the elasticity of the elastic member, whereby the hold of the holding means is released and the shutter member is allowed to rotate.

In order to achieve the above object, in a coin insertion device according to an exemplary embodiment of this invention, the shutter member has an opening and closing plate which opens and closes the coin discharge opening, and a releasing means, wherein a coin inserted from the coin insertion opening makes contact with the releasing means before coming into contact with the opening and closing plate.

BEST MODE FOR CARRYING OUT THE INVENTION

Figure 1:
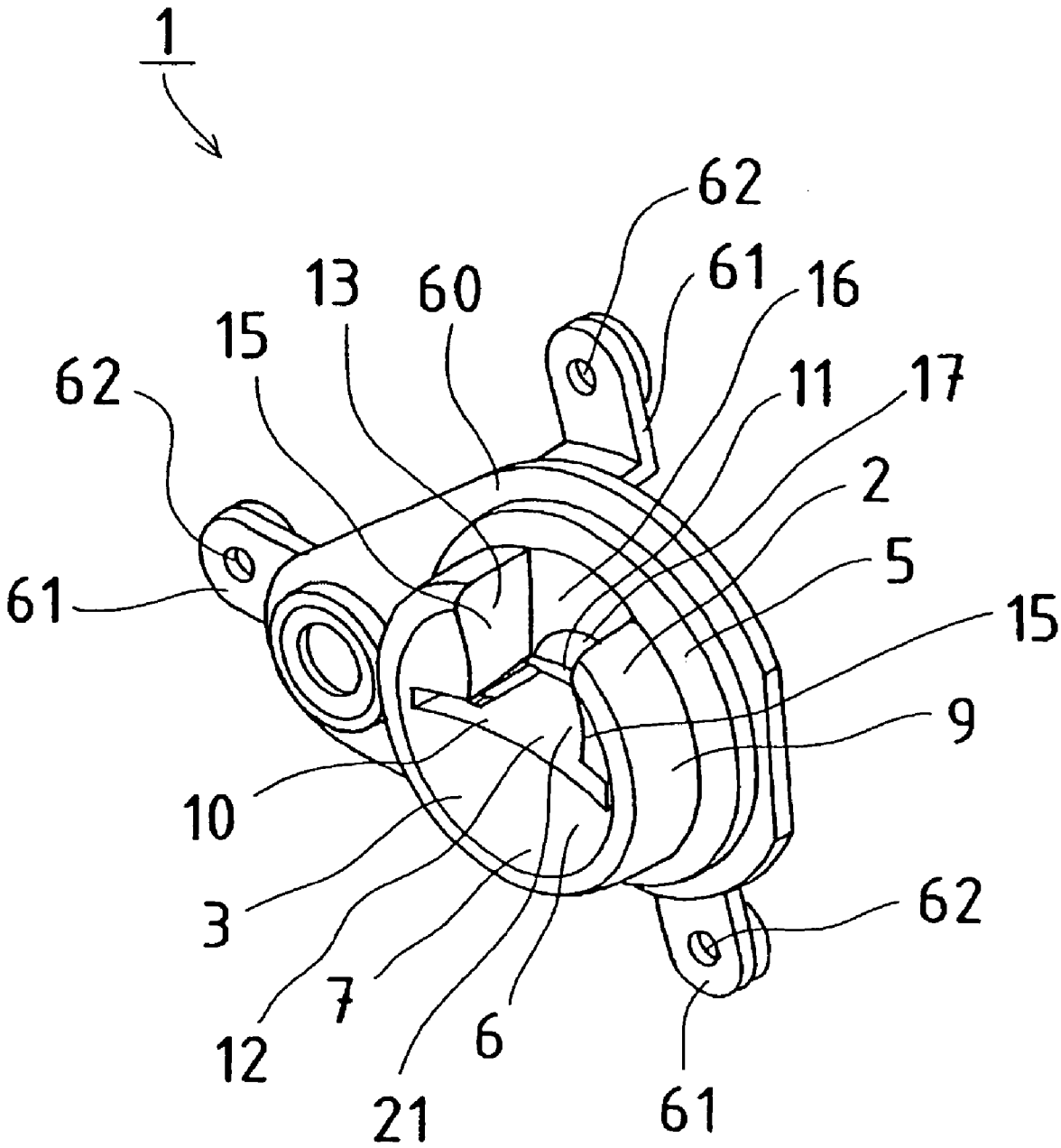
FIG. 1 is an overall oblique perspective view depicting one embodiment of the coin insertion device according to this invention when viewed from the front-upper direction.
Figure 2:
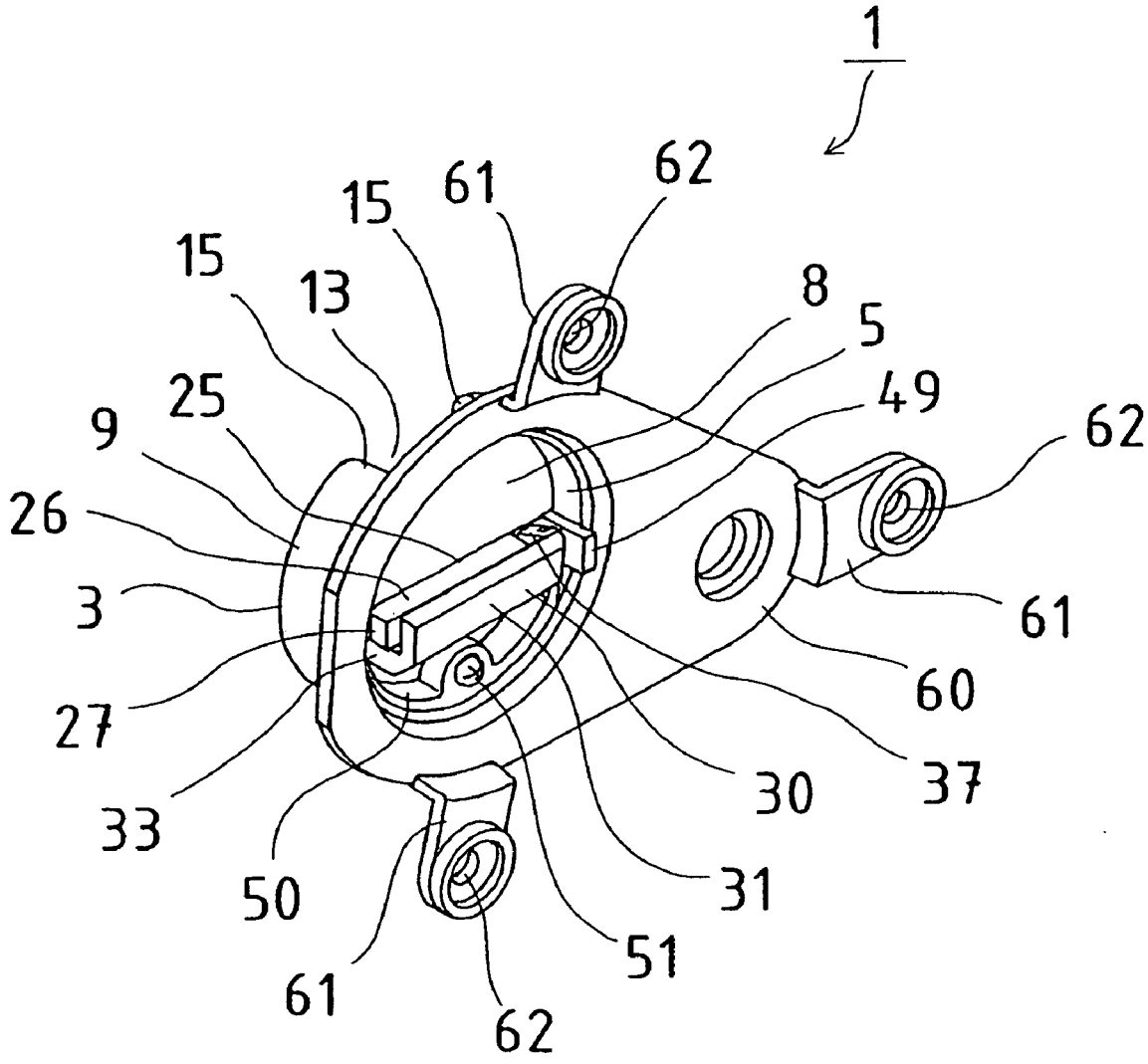
FIG. 2 is an overall oblique perspective view of the coin insertion device shown in FIG. 1 when viewed from the rear-upper direction.
Figure 3:
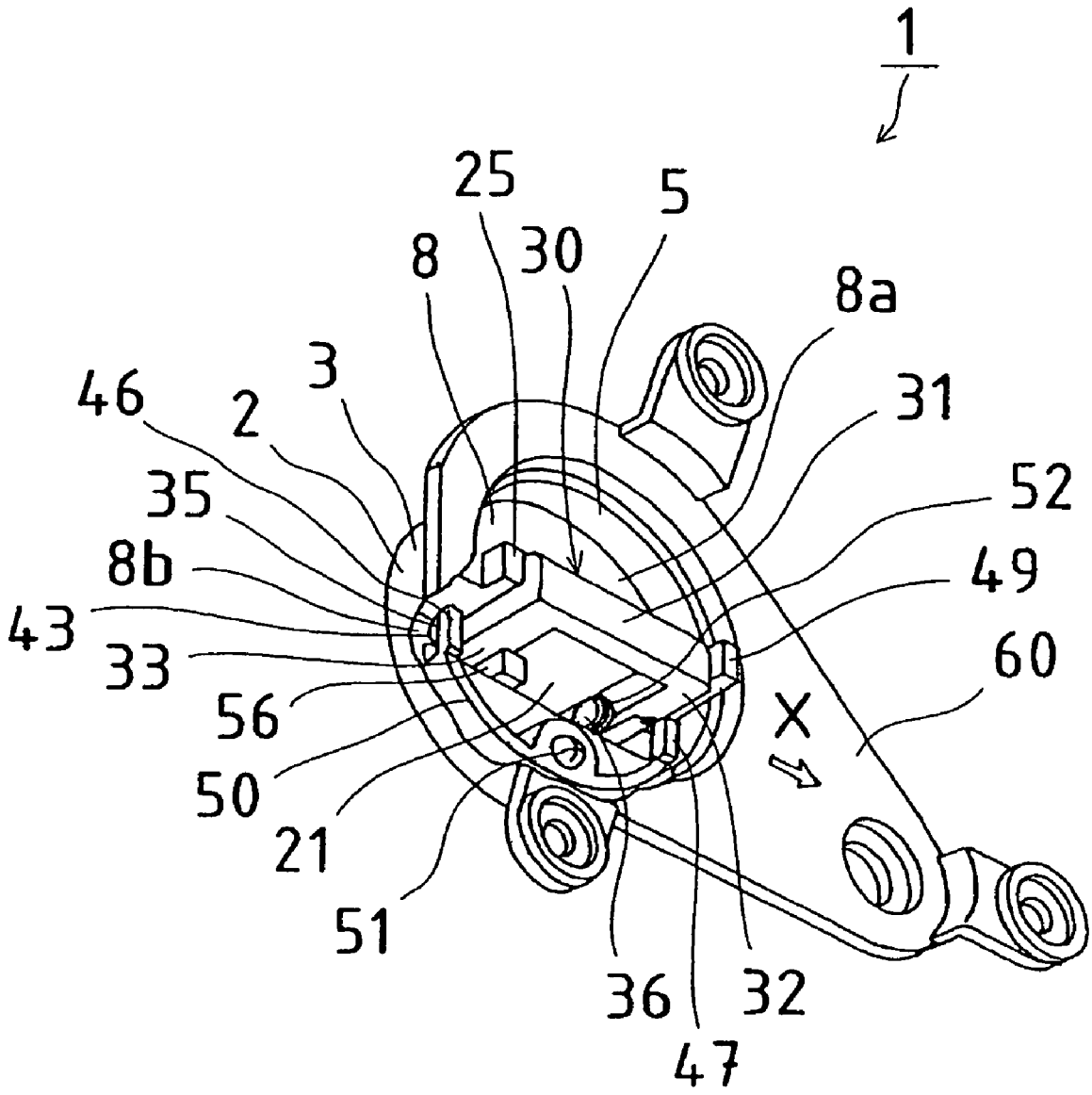
FIG. 3 is an overall oblique perspective view of the coin insertion device shown in FIG. 1 when viewed from the rear-lower direction.
Figure 4:
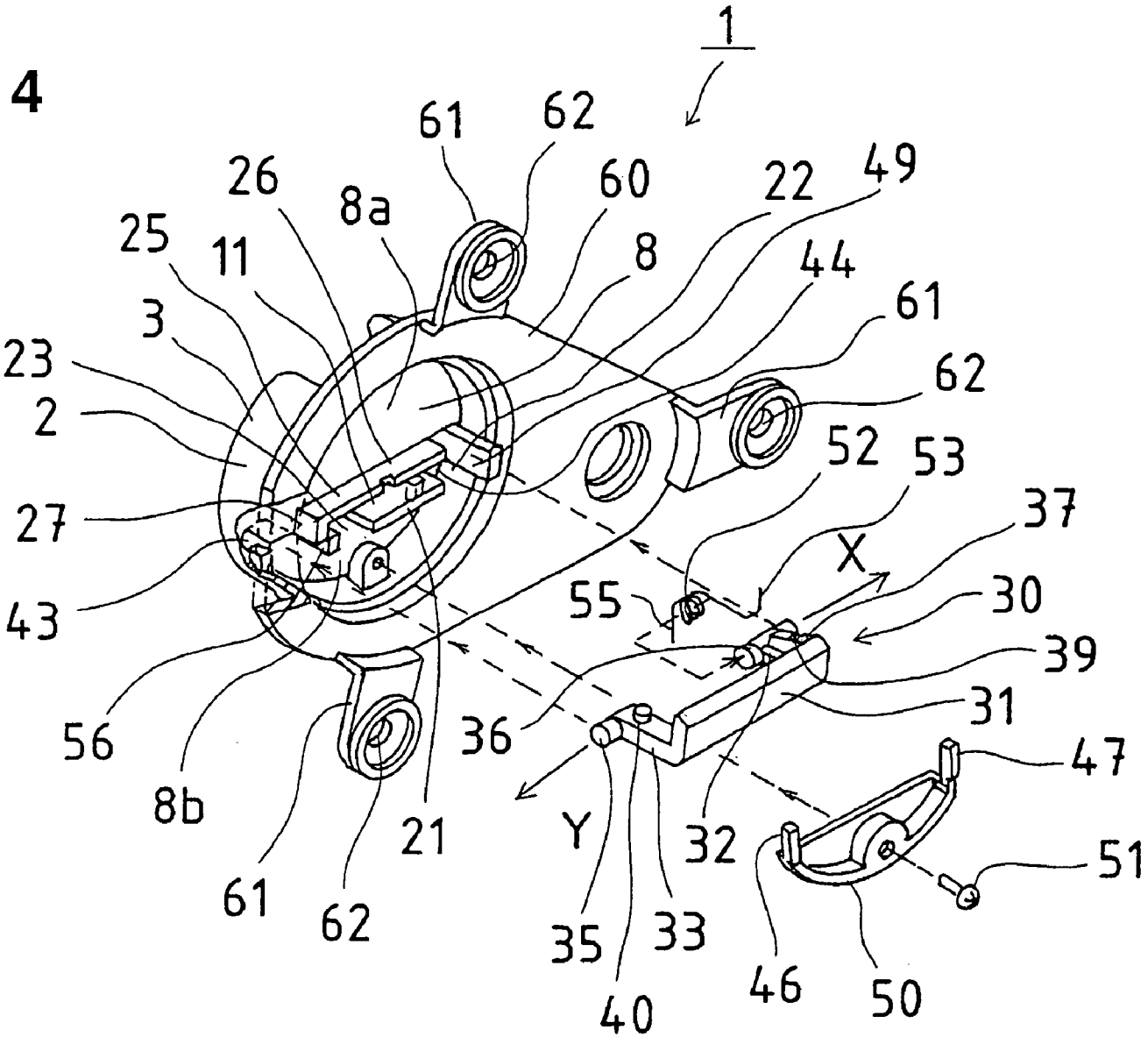
FIG. 4 is an exploded oblique perspective view of the coin insertion device shown in FIG. 1 when viewed from the rear-upper direction.
Figure 5:
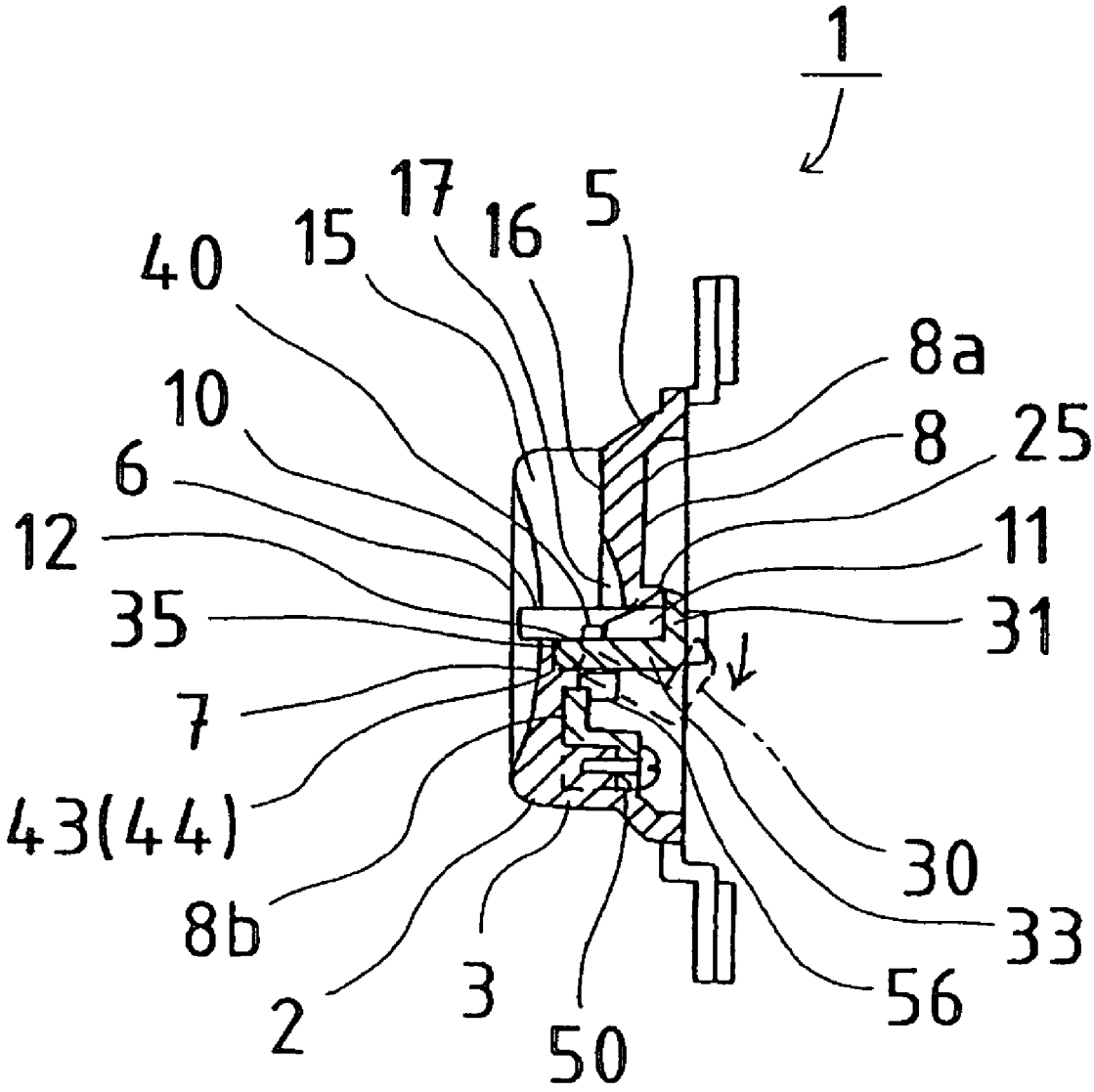
FIG. 5 is a lateral cross sectional view of the coin insertion device shown in FIG. 1.
Figure 6:
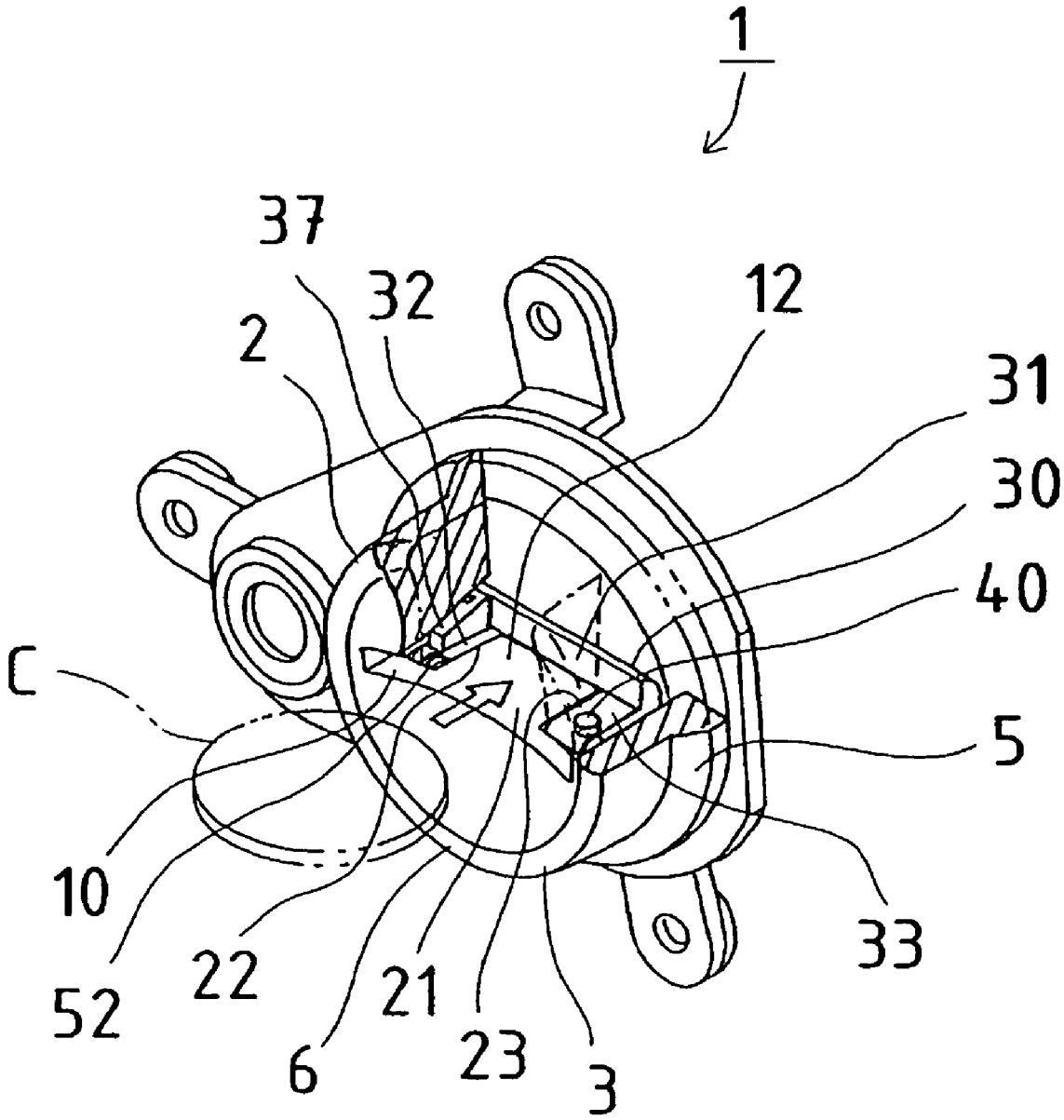
FIG. 6 is an overall oblique perspective view that illustrates the movement of the coin insertion device shown in FIG. 1 as viewed from the front-upper direction.
Figure 7:
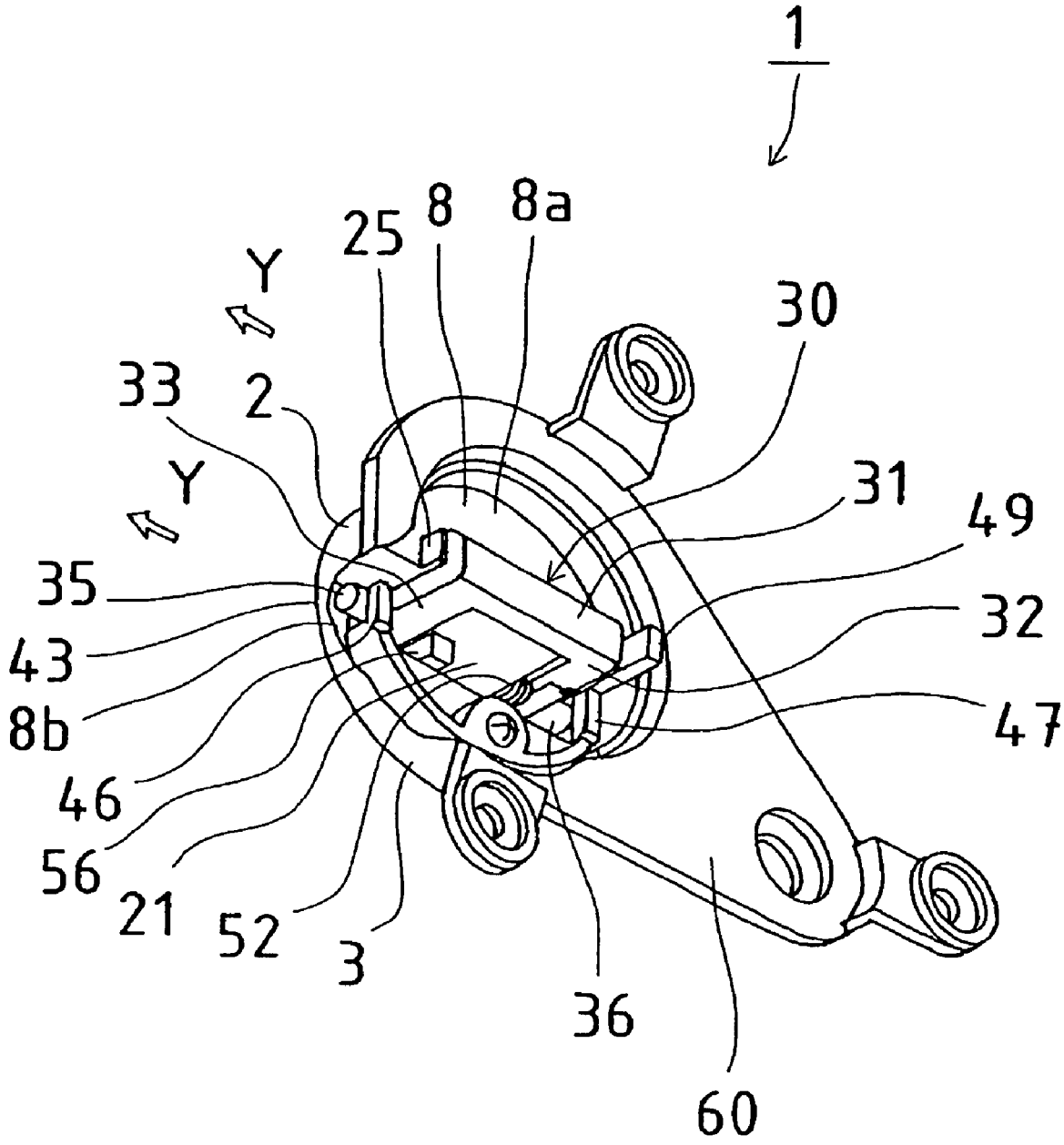
FIG. 7 is an overall oblique perspective view that illustrates the movement of the coin insertion device shown in FIG. 3 as viewed from the rear-lower direction.
Figure 8:
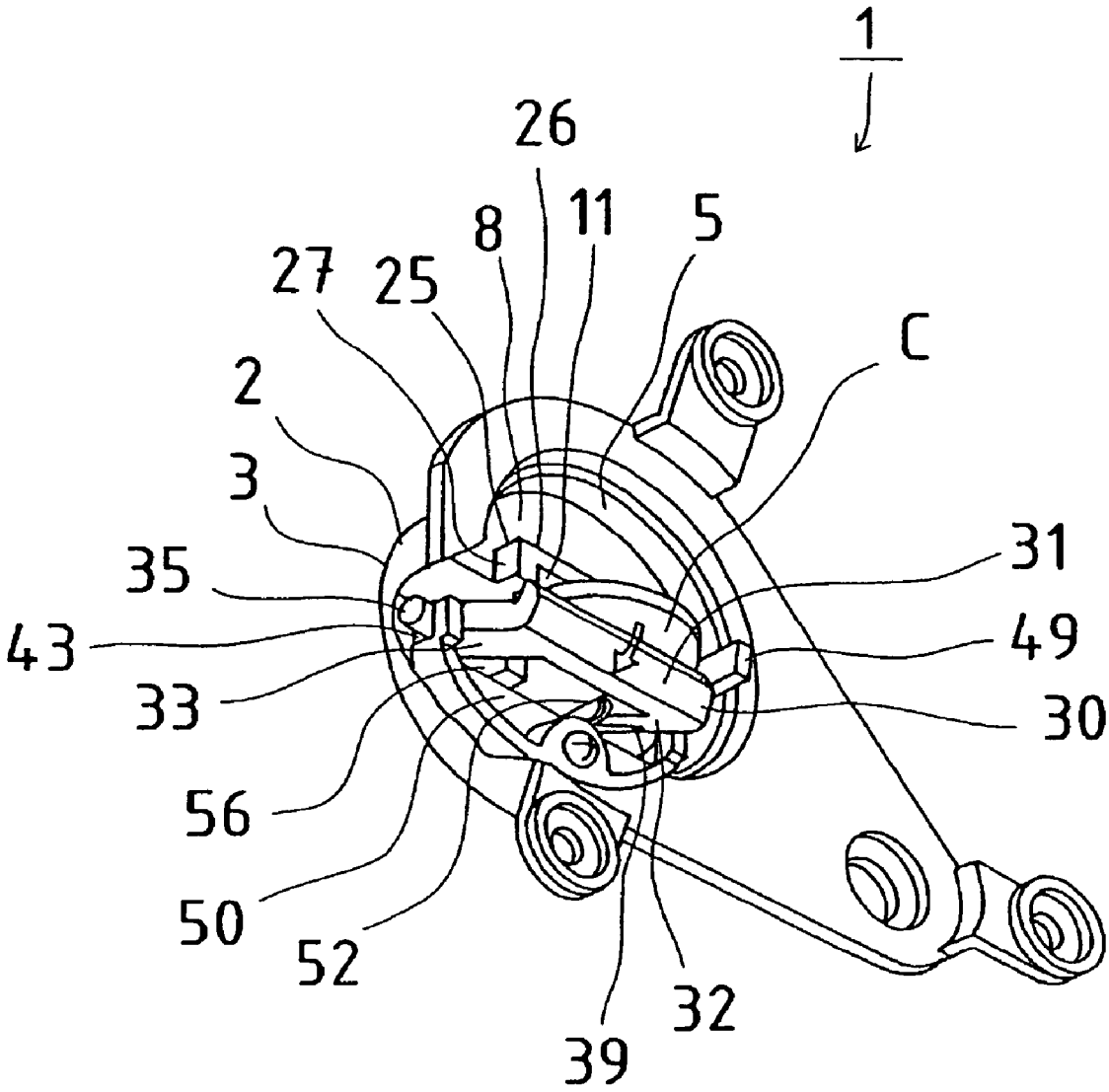
FIG. 8 is an overall oblique perspective view that illustrates the movement of the coin insertion device shown in FIG. 3 as viewed from the rear-lower direction.

An embodiment of the present invention will now be described on the basis of FIGS. 1 through 8. FIG. 1 is an overall oblique perspective view showing one embodiment of the coin insertion device according to this invention when viewed from the front-upper direction. FIG. 2 is an overall oblique perspective view of the coin insertion device shown in FIG. 1 when viewed from the rear-upper direction. FIG. 3 is an overall oblique perspective view of the coin insertion device shown in FIG. 1 when viewed from the rear-lower direction. FIG. 4 is an exploded oblique perspective view of the coin insertion device shown in FIG. 1 when viewed from the rear-upper direction. FIG. 5 is a lateral cross sectional view of the coin insertion device shown in FIG. 1. FIG. 6 is an overall oblique perspective view that illustrates the movement of the coin insertion device shown in FIG. 1 as viewed from the front-upper direction. FIGS. 7 and 8 are overall oblique perspective views that illustrate the movement of the coin insertion device shown in FIG. 3 as viewed from the rear-lower direction.

A device main body 2 of a coin insertion device 1 is provided with a coin passage 12 comprising a coin insertion opening 10 and a coin discharge opening 11, a shutter member 30 that can rotate in directions that open and close the coin discharge opening 11, an elastic member 52 that operates the shutter member 30 in a direction which closes the coin discharge opening 12, and a holding means 56 which holds the shutter member 30 in a non-rotatable condition in a state in which it keeps the coin discharge opening 11 closed.

The shutter member 30 is provided with a releasing means 40 which protrudes into the coin passage 12 and with which a coin C inserted from the coin insertion opening 10 comes into contact. When the coin C that is inserted from the coin insertion opening 10 comes in contact with the releasing means 40, the shutter member 30 is released from the hold of the holding means 56 and enabled to rotate (open and close freely), and the shutter member 30 receives a pressing force from the coin C so that it is enabled to open the coin discharge opening 11.

The shutter member 30 can move along a rotation center line, and is controlled by the elastic member 52 in a direction which closes the coin discharge opening 11 in one direction along the rotation center line (the X direction in FIG. 3). When the shutter member 30 is in a state in which it is operated in that one direction on the rotation center line, it is held in a non-rotatable condition by the holding means 56. Through contact with the coin C that is inserted from the coin insertion opening 10 against the releasing means 40, the shutter member 30 moves in the opposite direction (the Y direction in FIG. 7) on the rotation center line against the elasticity of the elastic member 52, whereby the hold of the holding means 56 is released and the shutter member 30 is allowed to rotate. The shutter member 30 is then pressed by the coin C such that it is enabled to open the coin discharge opening 11.

The shutter member 30 has an opening and closing plate 31 for opening and closing the coin discharge opening 11, and the releasing means 40. The shutter member 30 is configured such that the coin C inserted from the coin insertion opening 10 makes contact with the releasing means 40 before making contact with the opening and closing plate 31.

The coin insertion device will now be described in further detail. The device main body 2 of the coin insertion device 1 comprises a cylindrical base 3 and an annular part 5 that is provided at the rear of the base 3. The base 3 has a round front face 6. A concave portion 7 forming a gradual curve towards the inner side is formed in the front face 6. The coin insertion opening 10 is formed in a generally rectangular shape in the front face 6 of the base 3 in a direction traversing the front face 6. On a rear surface 8 of the base 3 is formed the coin discharge opening 11 that has the same shape as the coin insertion opening 10. In the base 3 is formed a coin passage 12 that links the coin insertion opening 10 and the coin discharge opening 11 without bending.

A groove 13 that extends in the lengthwise direction of the base 3 is formed at the top part of a perimeter 9 of the base 3, and the groove 13 penetrates completely through to the coin passage 12. The groove 13 comprises side portions 15, which are provided so as to extend from the perimeter 9 in the direction of the coin passage 12, and a front portion 16 that is formed between the side portions 15. A semicircular concave portion 17 that connects with the coin passage 12 is formed in the front portion 16. Should a coin or other object become jammed in the coin passage 12, the groove 13 facilitates removal of the jammed object.

The rear surface 8 of the base 3 is formed in a generally round shape, and is comprised of a semicircular upper rear surface part 8*a* and a semicircular lower rear surface part 8*b*. The lower rear surface part 8*b* is formed in a condition whereby it is closer to the front face 6 than the upper rear surface part 8*a*. At the top part of the lower rear surface part 8*b* is formed a guide plate 21 that forms the lower wall of the coin passage 12. On either side of the guide plate 21 are formed clearances 22 and 23.

A generally L-shaped latch member 25 which surrounds the top part of the coin discharge opening 11 and the left part thereof when viewed from the rear surface 8 is formed at the lower part of the upper rear surface part 8*a*. The latch member 25 comprises a first latch piece 26 that is roughly parallel with the guide plate 21, and a second latch piece 27 that is provided at a roughly right angle to the other direction (Y direction) of the first latch piece 26. The second latch piece 27 is formed such that it is shorter than the first latch piece 26.

In the vicinity of the lower edge of the two sides of the coin discharge opening 11 on the lower rear surface part 8*b*, a pair of bearing parts 43 and 44 are formed in a generally reversed C shape in a condition that is roughly parallel with the lower edge of the coin discharge opening 11. The rotation of the shutter member 30 is facilitated by the bearing parts 43 and 44. The shutter member 30 is comprised of an opening and closing plate 31 that is provided in a condition that is roughly parallel to the coin discharge opening 11 so as to open and close the coin discharge opening 11, and arm members 32 and 33 that are provided on the left and right side of the opening and closing plate 31. The rear end of the arm member 32 is mounted at a roughly right angle with respect to the opening and closing plate 31. A spindle 36 is provided at the front end of the arm member 32. At the top of the arm member 32 is formed an engaging plate 37 that rises in an inclined manner from the front end of the arm member 32 towards the rear end thereof. The spindle 36 is provided with a spring 52 that works the shutter member 30 in a direction that closes the coin discharge opening 11. Further, a latch hole 39 that latches one end 53 of the spring 52 is formed in the arm member 32. The rear end of the arm member 33 is also set at a roughly right angle to the opening and closing plate 31, and a spindle 35 is set at a front part of the arm member 33. A cylindrical release protrusion (releasing means) 40 is formed at the top of the arm member 33.

Rotation of spindles 35 and 36 is facilitated by the pair of bearing parts 43 and 44, and thus the shutter member 30 is rotatable with respect to the lower rear surface part 8*b*. A detachable mounting member 50 having a lower part that is curved similarly to the lower rear surface part 8*b* is fixed to the lower rear surface part 8*b* by a screw 51. At both side ends on the top surface of the mounting member 50 are set limiting pieces 46 and 47 that extend upward. The limiting pieces 46 and 47 cover the open sides of the generally reverse C shape of the pair of bearing parts 43 and 44. As a result, the spindles 35 and 36 are held back by the limiting pieces 46 and 47 so as not to project from the bearing parts 43 and 44. Further, the shutter member 30 can slide by a predetermined amount in the shaft center direction (rotation center line direction) of the spindles 35 and 36.

The spring member (elastic member) 52 as described above is wound around the spindle 36 of the arm member 32. One end 53 of the spring member (elastic member) 52 is latched to the latch hole 39, and another end 55 of the spring member (elastic member) 52 makes contact with the lower rear surface part 8*b*. The arm member 32 is operated in an upward direction (such that the opening and closing plate 31 blocks the coin discharge opening 11) by the elasticity of the spring member (elastic member) 52. The spring member (elastic member) 52 is inserted between the guide plate 21 and the arm member 32, and the arm member 32 is moved in one direction (X direction) of the shaft center direction (rotation center line direction) of the spindles 35 and 36 by the elasticity of the spring member (elastic member) 52.

The shutter member 30 is moved upward by the spring member (elastic member) 52, whereby the opening and closing plate 31 presses into contact with the latch member 25 and the guide plate 21 to keep the coin discharge opening 11 closed. At this time, the arm member 32 is positioned such that the upper surface of the arm member 32 and the upper surface of the guide plate 21 are at nearly the same height. The arm member 33 is also positioned such that the upper surface of the arm member 33 and the upper surface of the guide plate 21 are at nearly the same height, and the release protrusion 40 projects into the coin passage 12.

A rectangular column-shaped holding protrusion (holding means) 56 is provided in the lower rear surface part 8*b* in a position closer to the center than the bearing part 43 that is disposed on the left side as viewed from the rear surface, such that the holding protrusion 56 can make contact with the underside of the arm member 33 when the shutter member 30 attempts to rotate in a state where the coin discharge opening 11 is blocked by the shutter member 30. The holding protrusion 56 and bearing parts 43 and 44 are formed such that they are generally aligned in a straight line. In this connection, the clearance 23 between the bearing part 43 and the holding protrusion 56 is formed to be somewhat greater than the width of the arm member 33, and the width in the shaft center direction of the spindles 35 and 36 of a portion at which the holding protrusion 56 and the arm member 33 come into contact is formed to be less than the predetermined amount by which the shutter member 30 can slide in the shaft center direction (rotation center line direction) of the spindles 35 and 36. Therefore, when the shutter member 30 rotates in a state in which the shutter member 30 is slid by the predetermined amount in the other direction (Y direction) in the shaft center direction (rotation center line direction) of the spindles 35 and 36, the arm member 33 can rotate by passing through the clearance 23 without making contact with the holding protrusion 56. Further, a stopper plate 49 is provided on the lower rear surface part 8*b* so as to surround the right side of the coin discharge opening 11 as viewed from the rear surface. A clearance 22 that is slightly greater than the width of the arm member 32 is formed between the stopper plate 49 and the right side end of the guide plate 21, and the arm member 32 is contained in the clearance 22. As described in the foregoing, the shutter member 30 is operated in one direction (X direction) of the shaft center direction (rotation center line direction) of the spindles 35 and 36 by a spring member (elastic member) 52, and the engaging plate 37 of the arm member 32 engages with the stopper plate 49. When the engaging plate 37 of the shutter member 30 is engaged with the stopper plate 49, the lower surface of the arm member 33 makes contact with the holding protrusion 56 formed in the lower rear surface part 8*b*, and thus the shutter member 30 cannot rotate in a direction in which the opening and closing plate 31 opens the coin discharge opening 11.

The annular part 5 is provided at the outer circumference of the back end of the base 3. On the periphery of the annular part 5 is mounted a flange 60 that is shaped with one side projecting. At a predetermined position of the flange 60 is set a mounting arm 61. A mounting hole 62 is provided in the mounting arm 61.

The coin insertion device 1 has the above described organization, and can be mounted in an automatic vending machine that does not require electricity, such as a capsule dispenser. The coin insertion device 1 can be mounted in a predetermined position of an automatic vending machine by inserting a screw or the like into the mounting hole 62 of the mounting arm 61 and screwing the screw into the casing of an unshown automatic vending machine. In this connection, when a coin C is inserted into the automatic vending machine from the coin insertion device 1, an operation lever thereof is enabled. When the operation lever is operated a product such as a capsule can be taken out from the automatic vending machine.

The initial state of the coin insertion device 1 is one in which the coin discharge opening 11 of the coin passage 12 is blocked by the shutter member 30. In this initial state, the opening and closing plate 31 is moved upward by the elasticity of the spring member (elastic member) 52 so that the opening and closing plate 31 presses into contact with the latch member 25 and the guide plate 21 to keep the coin discharge opening 11 closed. Further, the opening and closing plate 31 is worked in one direction (X direction) of the shaft center direction (rotation center line direction) of the spindles 35 and 36 by the elasticity of the spring member (elastic member) 52 to engage the engaging plate 37 with the stopper plate 49. In this state, even if the shutter member 30 rotates, the lower surface of the arm member 33 comes into contact with the holding protrusion (holding means) 56 formed in the lower rear surface part 8*b*, and thus the shutter member 30 cannot rotate in a direction in which the closing plate 31 opens the coin discharge opening 11.

In the initial state described above, since the coin discharge opening 11 is blocked by the opening and closing plate 31 it is possible to prevent foreign substances such as dust or moisture caused by rainfall or the like from entering the automatic vending machine. Further, even if a person, for mischievous reasons or the like, attempts to push open the opening and closing plate 31 using a plate piece or the like, since the arm member 33 that is linked to the opening and closing plate 31 is held in a non-rotatable condition by the holding protrusion (holding means) 56, the opening and closing plate 31 will not rotate. It is therefore possible to prevent such mischievous acts from occurring and the coin insertion device 1 and/or automatic vending machine from being damaged.

When a coin C is inserted from the coin insertion opening 10, the outside rim of the coin C comes into contact with the release protrusion (releasing means) 40 that protrudes within the coin passage 12. Because the release protrusion (releasing means) 40 is pressed to the side with respect to the coin passage 12 by the outer rim of the coin C, the shutter member 30 moves by a predetermined amount in the other direction (Y direction) of the shaft center direction (rotation center line direction) of the spindles 35 and 36 against the elasticity of the spring member (elastic member) 52, and the arm member 33 is released from the holding protrusion (holding means) 56 and enabled to rotate through the clearance 23. As a result, the opening and closing plate 31 together with the shutter member 30 is enabled to rotate in the direction that opens the coin discharge opening 11. After the coin C comes into contact with the release protrusion (releasing means) 40, it makes contact with the opening and closing plate 31 that is freely rotatable to push open the opening and closing plate 31 against the elasticity of the spring member 52 and open the coin discharge opening 11, and is thus enabled to enter a coin selection device or the like of the automatic vending machine from the coin discharge opening 11.

When the coin C is discharged from the coin discharge opening 11, the opening and closing plate 31 is rotated upward by the elasticity of the spring member (elastic member) 52, and presses into contact with the latch member 25 and the guide plate 21 to close the coin discharge opening 11. Further, the shutter member 30 is moved in one direction (the X direction) of the shaft center direction (rotation center line direction) of the spindles 35 and 36 by the elasticity of the spring member (elastic member) 52, the engaging plate 37 engages with the stopper plate 49, the arm member 33 is held in a non-rotatable state by the holding protrusion (holding means) 56, and thus the opening and closing plate 31 is not allowed to rotate in a direction that opens the coin discharge opening 11. Thus, upon insertion of the coin C, the coin insertion device 1 immediately returns to its initial state.

As described above, the coin insertion device 1 is useful to prevent mischief resulting from insertion of a piece of plate or the like therein. Further, in the case of a small-diameter coin, since the coin does not make contact with the release protrusion (releasing means 40), the shutter member 30 is not capable of being rotated and thus the coin insertion device 1 also acts as a coin selector.

Effect of Invention

As described above, in the coin insertion device according to the present invention, since the coin discharge opening is closed by a shutter member, there is an advantage that the entry of dust, moisture and the like from the coin insertion opening can be prevented, thereby keeping the inside of the automatic vending machine free from dirt or corrosion. Further, since the shutter member is held in a state in which it keeps the coin discharge opening closed by the holding means, the coin discharge opening will not open even if the shutter member is pushed with an object other than a coin, such as a stick. There is thus an advantage that a mischievous act such as pushing open the shutter member using a thin plate can not be carried out. When a coin is inserted from the coin insertion opening the coin makes contact against the releasing means of the shutter member, whereby the hold of the shutter member by the holding means is released and the shutter member is allowed to open and close freely. There is thus an advantage that the shutter member can be pushed open by a coin to open the coin discharge opening and discharge the coin from the coin discharge opening.

The coin insertion device according to the present invention has the advantage that it has a simple structure and can be produced at a low cost. Further, since opening and closing of the shutter member does not require electrical driving means, it can be mounted in an automatic vending machine that does not use electricity, such as a capsule dispenser.

[Description of Symbols]

C . . . coin, 1 . . . coin insertion device, 2 . . . device main body, 3 . . . base, 5 . . . annular part, 6 . . . front face, 7 . . . concave portion, 8 . . . rear surface, 8*a* . . . upper rear surface part, 8*b* . . . lower rear surface part, 9 perimeter, 10 . . . coin insertion opening, 11 . . . coin discharge opening, 12 . . . coin passage, 13 . . . groove, 15 . . . side portion, 16 . . . front portion, 17 . . . concave portion, 21 . . . guide plate, 22 . . . clearance, 23 . . . clearance, 25 . . . latch member, 26 . . . first latch piece, 27 . . . second latch piece, 30 . . . shutter member, 31 opening and closing plate, 32 . . . arm member, 33 . . . arm member, 35 . . . spindle, 36 . . . spindle, 37 . . . engaging plate, 39 . . . latch hole, 40 . . . release protrusion (releasing means), 43 . . . bearing part, 44 . . . bearing part, 46 . . . limiting piece, 47 . . . limiting piece, 49 stopper plate, 50 . . . mounting member, 51 . . . screw, 52 spring member (elastic member), 53 . . . one end, 55 . . . other end, 56 . . . holding protrusion (holding means), 60 . . . flange, 61 . . . mounting arm, 62 . . . mounting hole

INDUSTRIAL APPLICABILITY

The present invention can be applied to the coin insertion opening of an automatic vending machine that does not use electricity, such as a capsule dispenser that is placed at the front of a store.

The invention claimed is:

1. A coin insertion device, in which a device main body is provided with a coin passage, comprising:

a coin insertion opening;

a coin discharge opening;

a shutter member that is rotatable in directions that open and close the coin discharge opening;

an elastic member that biases the shutter member in a direction that closes the coin discharge opening;

a holding means which holds the shutter member in a non-rotatable condition in a state in which the shutter member keeps the coin discharge opening closed; and releasing means that projects in the coin passage and with which a coin inserted from the coin insertion opening comes in contact is provided in the shutter member;

wherein by contact of a coin inserted from the coin insertion opening with the releasing means, the shutter member is released from a hold of the holding means and is allowed to rotate;

wherein the shutter member is movable along a rotation center line and is biased in the direction for closing the coin discharge opening in one direction on the rotation center line by the elastic member, and the holding means holding the shutter member in the non-rotatable state when the shutter member is in the state in which the shutter member is biased in the one direction on the rotation center line, and by contact with a coin inserted from the coin insertion opening with the releasing means, the shutter member moves in another direction on the rotation center line against an elasticity of the elastic member, whereby the hold of holding means is released and the shutter member is allowed to rotate.

2. The coin insertion device according to claim 1, wherein the shutter member has an opening and closing plate that opens and closes the coin discharge opening, and the releasing means, and the releasing means is configured such that a coin inserted from the coin insertion opening comes in contact with the releasing means before making contacting with the opening and closing plate.

* * * * *